US008778863B2

(12) United States Patent
Pipko

(10) Patent No.: US 8,778,863 B2
(45) Date of Patent: Jul. 15, 2014

(54) SOAPS FROM ORGANIC RESIDUES AND METHOD OF PRODUCING THE SAME

(75) Inventor: Gregory Pipko, Katzrin (IL)

(73) Assignee: Caper Naum Vista Olive Oil Market Ltd., Katzrin (IL)

( * ) Notice: Subject to any disclaimer, the term of this patent is extended or adjusted under 35 U.S.C. 154(b) by 546 days.

(21) Appl. No.: 12/965,982

(22) Filed: Dec. 13, 2010

(65) Prior Publication Data

US 2011/0082069 A1 Apr. 7, 2011

Related U.S. Application Data

(63) Continuation-in-part of application No. 11/908,889, filed as application No. PCT/IL2006/000338 on Mar. 15, 2006, now abandoned.

(30) Foreign Application Priority Data

Mar. 17, 2005 (IL) ..... 167500

(51) Int. Cl.
*C11D 3/60* (2006.01)

(52) U.S. Cl.
USPC ..... 510/463; 510/491

(58) Field of Classification Search
USPC ..... 510/463, 491
See application file for complete search history.

(56) References Cited

U.S. PATENT DOCUMENTS

| | | | | |
|---|---|---|---|---|
| 2,333,614 | A | 8/1945 | Percy | |
| 2,383,614 | A * | 8/1945 | Percy | 554/167 |
| 3,823,774 | A * | 7/1974 | Chiu | 166/252.1 |
| 4,606,839 | A * | 8/1986 | Harding | 510/145 |
| 5,206,019 | A * | 4/1993 | Nichols | 424/401 |
| 2002/0016271 | A1 * | 2/2002 | Racherla | 510/141 |
| 2005/0003975 | A1 * | 1/2005 | Browne et al. | 510/101 |
| 2005/0238602 | A1 * | 10/2005 | Modak et al. | 424/70.11 |

* cited by examiner

*Primary Examiner* — Nicole M Buie-Hatcher
*Assistant Examiner* — M. Reza Asdjodi
(74) *Attorney, Agent, or Firm* — Ladas & Parry LLP

(57) ABSTRACT

A novel method of producing soaps from organic residues, in which otherwise valueless organic residues are saponified, is disclosed. The method comprises steps of (a) preparing a solution of a base in water; (b) reacting said solution with stearic acid; (c) adding glycerol; (d) adding a borate; (e) adding a surface-active agent; (f) dispersing an organic residue within the mixture; and (g) reacting said organic residue until a homogeneous soap composition is obtained. A novel soap made by this process is also disclosed.

26 Claims, No Drawings

SOAPS FROM ORGANIC RESIDUES AND METHOD OF PRODUCING THE SAME

REFERENCE TO RELATED APPLICATIONS

This application is a Continuation-in-Part of U.S. patent application Ser. No. 11/908,889, filed 17 Sep. 2007, now abandoned which is a U.S. national phase entry of PCT/IL2006/000338 filed Mar. 15, 2006.

FIELD OF THE INVENTION

The present invention generally relates to soaps obtained from organic residues and to a method of producing such soaps.

BACKGROUND OF THE INVENTION

Soap was traditionally made by mixing animal fats with lye obtained from such sources as the ashes of a wood tire. In modern times, many soaps are mixtures of sodium or potassium salts of fatty acids and are produced from oils or fats by reacting them at elevated temperatures with an alkali such as sodium or potassium hydroxide.

Vegetable oils, as such as olive oil, are produced by pressing oil-bearing seeds, usually by hydraulic power presses. For example, olive presses known in the art work by the application of pressure to olive paste to separate the liquid oil and vegetation water from the solid material. The oil and vegetation water are then separated by standard decantation.

This method is still widely used today, and it remains a valid way of producing high quality olive oil if adequate precautions are taken. First the olives are ground into an olive paste, using large grindstones. The olive paste generally stays under the stones for about half an hour, this has three objectives, namely to guarantee that the olives are well ground, to allow enough time for the olive drops to join to form the largest droplets of oil and to allow the fruit enzymes to produce some of the oil aromas and taste. Rarely, olive oil mills use a modern crushing method with a traditional press. After grinding, the olive paste is spread on fiber disks, which are stacked on top of each other, then placed into the press. Traditionally the disks were made of hemp or coconut fiber, but nowadays they are made of synthetic fibers which are easier to clean and maintain. These disks are then put on a hydraulic piston, forming a pile. Pressure is applied on the disks, thus compacting the solid phase of the olive paste and percolating the liquid phases (oil and vegetation water). The applied hydraulic pressure can go to 400 atm. To facilitate separation of the liquid phases, water is run down the sides of the disks to increase the speed of percolation. The liquids are then separated either by a standard process of decantation or by the means of a faster vertical centrifuge. The traditional method is a valid form of producing high quality olive oil, if after each extraction the disks are properly cleaned from the remains of paste; if not the leftover paste will begin to ferment thereby producing inconsistencies of flavors (called defects) that will contaminate the subsequently produced olive oil. A similar problem can affect the grindstones, that in order to assure perfect quality, also require cleaning after each usage.

Various industrial decanters are applicable in this invention. With the standard three phases oil decanter, a portion of the oil polyphenols is washed out due to the higher quantity of added water (when compared to the traditional method), producing a larger quantity of vegetation water that needs to be processed. The two phase oil decanter was created as an attempt to solve these problems. Sacrificing part of its extraction capability, it uses less added water thus reducing the phenol washing. The olive paste is separated into two phases: oil and wet pomace. This type of decanter, instead of having three exits (oil, water and solids), has only two. The water is expelled by the decanter coil together with the pomace, resulting in a wetter pomace that is much harder to process industrially. Many pomace oil extraction facilities refuse to work with these materials because the energy costs of drying the pomace for the hexane oil extraction often make the extraction process sub-economical. In practice, then, the two phase decanter solves the phenol washing problem but increases the residue management problem.

This process leaves as a residue a dense cake of crushed and compressed seed husks from which further extraction of oil would cost more than the value of the oil extracted. This dense slab is used to some extent for animal feed, but most of it is discarded as a useless agricultural effluent of no economic value.

U.S. Pat. Nos. 3,823,774 and 3,892,668 to Chiu disclose a digested alkaline tall oil pitch soap composition produced by heating tall oil pitch with excess aqueous alkali. Tall oil pitch is a byproduct of the Kraft process for making paper, and comprises fatty acids and rosin acids and their esters and approximately one-third unsaponifiable organic material. The soap is produced by mixing, for each part by weight of tall oil pitch, 1-5 parts by weight of an aqueous base solution containing 20-80% excess alkalinity, and heating the mixture of a time and temperature equivalent to from about 4 hours at 70° C. to about 16 hours at 100° C.

U.S. Pat. No. 4,483,742 to Bridle discloses liquid soaps for use in paper recycling and other industrial cleaning or scouring processes. The liquid soap comprises an aqueous partially saponified mixture comprising 1 part pine oil (a mixture of terpene alcohols and hydrocarbons) and from 1 to 20 parts of a soap-making fatty acid, such as tall oil or distilled oil. The mixture is preferably saponified by use of 30% sodium hydroxide solution. The liquid soap may contain less than 10% water.

U.S. Pat. No. 6,020,509 to Weerasooriya discloses a process for producing a surfactant composition by partially saponifying an alkoxylated triglyceride with an alkali metal hydroxide such as sodium hydroxide and recovering a surfactant composition comprising soap and moisturizing agents comprised of alkoxylated monoglycerides and un-reacted alkoxylated triglycerides.

U.S. Pat. No. 6,380,153 to Carlson discloses methods of producing surfactant compositions in which processed plant material is used to enhance the saponification process to produce surfactant compositions having enhanced surfactant, mechanical cleaning and emollient characteristics. The plant material provides additional oils and triglycerides for reaction in the saponification process and provides an improved reaction interface, thereby producing surfactant compositions of improved character.

U.S. Pat. No. 6,440,908 to Racherla discloses a high-moisture bar comprising at least 30% anhydrous soap and 20-60% water, in which a borate compound is used to structure the water and thus enable the bar to retain a high moisture content without compromising other bar properties.

Hence a soap made of organic residues from olive oil manufacture (e.g. said dense slab or cake of crushed and compressed seed husks) is still a long felt need.

SUMMARY OF THE INVENTION

It is therefore one object of the present invention to provide a novel method of producing soaps from organic residues.

The method comprises steps of (a) preparing a solution of a base in water; (b) reacting said solution with stearic acid; (c) adding glycerol; (d) adding a borate; (e) adding a surface-active agent; (f) dispersing an organic residue within the mixture; and (g) reacting said organic residue until a homoaeneous soap composition is obtained.

It is a further object of the present invention to disclose such a method, wherein said step of dispersing an organic residue within the mixture further comprises a step of dispersing an organic residue comprising olive seed residue remaining after the extraction of olive oil from said olives within the mixture.

It is a further object of the present invention to disclose such a method, wherein said step of dispersing an organic residue within the mixture further comprises a step of dispersing an organic residue comprising crushed and compressed olive seed husks within the mixture.

It is a further object of the present invention to disclose such a method, wherein said step of dispersing an organic residue within the mixture further comprises a step of dispersing within the mixture an organic residue chosen from the group consisting of olive products, olive tree products, olive oil production residuals, wine production residues, fruit or vegetable residues, residue from the production of canned food, and any combination thereof.

It is a further object of the present invention to disclose such a method, wherein said step of dispersing an organic residue within the mixture further comprises a step of dispersing within the mixture an organic residue chosen from the group consisting of water immiscible process products obtained from oil cake milling; water miscible process products obtained from oil cake milling; byproducts of oil cake milling; and any combination thereof.

It is a further object of the present invention to disclose such a method, wherein said step of dispersing an organic residue within the mixture further comprises a step of dispersing within the mixture an organic residue comprising crushed seeds obtained from oil cake milling.

It is a further object of the present invention to disclose such a method, wherein said crushed seeds are crushed olive crushed pits.

It is a further object of the present invention to disclose such a method, wherein said step of dispersing an organic residue within the mixture further comprises a step of dispersing within the mixture an organic residue comprising a byproduct of juice production.

It is a further object of the present invention to disclose such a method, wherein said base is chosen from the group consisting of NaOH, KOH, $Na_2CO_3$, $K_2CO_3$, and mixtures thereof.

It is a further object of the present invention to disclose such a method, wherein said base is NaOH.

It is a further object of the present invention to disclose such a method, wherein said borate is chosen from the group consisting of boric acid; any borate of a metal chosen from the group consisting, of sodium, potassium, magnesium, calcium, barium, manganese, and iron; and any combination thereof.

It is a further object of the present invention to disclose such a method, wherein said step of adding borate further comprises a step of adding between 0.1% and 5.0% borate relative to the total weight of the ingredients.

It is a further object of the present invention to disclose such a method, wherein said step of adding borate further comprises a step of adding between 0.15% and 0.5% borate relative to the total weight of the ingredients.

It is a further object of the present invention to disclose such a method, wherein said surface-active agent is chosen from the group consisting of sulfonates; alkyl sulfate anionic surfactants; laurates; ethanolamines; polyethanolmides; mixtures of ethanolamides of lauric acid; and any mixture thereof.

It is a further object of the present invention to disclose such a method, wherein said surface-active agent is sodium laureth sulfate.

It is a further object of the present invention to disclose such a method, fbnhur comprising a step of adding at least one etheric oil.

It is a further object of the present invention to disclose such a method, wherein said etheric oil comprises at least one etheric oil obtained from fruits or vegetables selected from the group consisting of St. John's wort, calendula, arnica, niseseed, flax, peppermint, spearmint, tea tree, pine, fir, larch, juniper, eucalyptus, citrus, sandalwood, clove, cinnamon, patchouli, lavender, carnation, chamomile, bergamot, citrus, lemon grass, sage, rosemary, caraway, marjoram, thyme, basil and fennel.

It is a further object of the present invention to disclose such a method, wherein said step of adding at least one etheric oil further comprises a step of adding between 0.1 and 5.0% etheric oil relative to the total weight of all of the ingredients.

It is a further object of the present invention to disclose such a method according to any of the above, further comprising a step of adding at least one preservative.

It is a further object of the present invention to disclose such a method, wherein said preservative is chosen from the group consisting of biocides, bactericides, and fungicides.

It is a further object of the present invention to disclose such a method, wherein said preservative is selected from the group consisting of methylparaben, propylparaben, and combinations thereof.

It is a further object of the present invention to disclose such a method according to any of the above, additionally comprising a step of admixing at least one additive.

It is a further object of the present invention to disclose such a method, wherein said additive is chosen from the group consisting of perfuming agents, stabilizers, thickeners, emulsifiers, vitamins, radical scavengers, conditioners, antioxidants, lipophilic plant extracts, hydrophilic plant extracts, and any combination thereof.

It is a further object of the present invention to disclose such a method as defined in any of the above, additionally comprising a step of admixing at least one viscosity-regulating filler.

It is a further object of the present invention to disclose such a method, wherein said viscosity-regulating filler is selected from the group consisting of calcium carbonate, talc, dolomite, perlite, magnesium carbonate, and any mixture thereof.

It is a further object of the present invention to disclose such a method, wherein said steps of adding glycerol, adding borate, and adding a surface active agent are performed sequentially following said step of reacting said stearic acid with said solution of a base in water.

It is a further object of the present invention to disclose such a method, wherein said step of adding said surface active ingredient is performed following complete dissolution of said glycerol and said borate.

It is a further object of the present invention to disclose such a method as defined in any of the above wherein at least one of said step of reacting stearic acid with said solution of abuse in water; said step of adding glycerol; and said step of adding borate is performed at a temperature of not more than 80° C.

It is a further object of the present invention to disclose such a method as defined in any of the above, wherein at least one of said step of reacting stearic acid with said solution of a base in water; said step of adding glycerol; and said step of adding borate is performed at a temperature of 50° C.

It is a further object of the present invention to disclose such a method, wherein said step of dispersing said organic residue within said mixture further comprises steps of (a) cleaning olives; (b) grinding said olives to paste; (c) mixing said paste, thereby increasing the yield of olive oil; (d) separating the pomace from the olive oil and aqueous phases; and (e) dispersing said pomace within said mixture.

It is a further object of the present invention to disclose such a method, further comprising steps of (a) reacting at least part of said olive oil with a base until a homogeneous soap phase is obtained; and (b) mixing said soap derived from said olive oil with said organic-residue-based soap.

It is a further object of the present invention to disclose such a method, further comprising a step of removing at least a portion of the pits from the olives prior to said step of grinding said olives to paste.

It is a further object of the present invention to disclose such a method, further comprising a step of mixing said pits with said pomace.

It is a further object of the present invention to disclose such a method, further comprising a step of mixing at least part of said aqueous phase with mixture.

It is a further object of the present invention to disclose such a method, wherein said step of separating the pomace from the olive oil and aqueous phases is performed by using a decanter chosen from the group consisting of a tri-phase decanter and a two-phase decanter.

It is a further object of the present invention to disclose such a method, wherein said step of grinding said olives to paste is performed by using a disc grinder.

It is a further object of the present invention to disclose such a method, wherein at least one of said steps is performed in an oxygen-free environment.

It is a further object of the present invention to disclose a soap obtained according to the method as defined in any of the above.

It is a further object of the present invention to disclose a method of making, soaps from organic residues, said method comprising hydrolyzing one or more natural oils such that a water-soluble soap is obtained and dispersing organic residues in a water miscible solution until a homogeneous soap composition phase is obtained. Preferably, said method further comprises steps of admixing preservatives, additives, fillers etc.

It is another object of the present invention to provide soap, wherein said soap is obtained by dispersing synthetic and/or natural soap and liquid organic residues by hydrolyzing at least one natural oil such that a water-soluble soap is obtained; and dispersing organic residues in a water miscible solution until a homogeneous soap composition phase is obtained.

The soap preferably comprises ingredients selected from preservatives, additives, fillers etc.

More particularly, the present invention provide an environmentally friendly and cost effective means of recycling the dense cake of crushed and compressed seed husks obtained from olive oil processing, such that natural or at least partially natural soaps are obtained.

DETAILED DESCRIPTION OF THE PREFERRED EMBODIMENTS

The following description is provided in order to enable any person skilled in the art to make use of the invention herein disclosed and sets forth the best modes contemplated by the inventor of carrying out the invention. As is customary, it will be understood that no limitation of the scope of the invention is thereby intended. Further modifications will remain apparent to those skilled in the art, since the generic principles of the present invention have been defined specifically to provide a method of producing soaps from organic residues and soaps obtained by dispersing synthetic and/or natural soap and liquid organic residues to form a soap product.

The term "organic residues" refers hereinafter to organic biomass obtained as a byproduct of an agricultural or industrial process that involves processing of matter derived from plants or animals. As a non-limiting example, in the specific case of olive oil production, the term refers to any of the residual product, which is typically a dense slab or "cake" of crushed and/or compressed seed husks.

In the descriptions of the preferred embodiments of the invent on given below, the fractions of the various ingredients present are given on a weight basis unless specifically described otherwise.

Hence, a novel method of producing soaps from organic residues is hereto disclosed. In a preferred embodiment of the invention, the following general procedure is performed. First, a base (in preferred embodiments, NaOH) is dissolved in water. Typically, the ratio of NaOH:$H_2O$ is 8% by weight. Stearine (stearic acid) is then added to the basic solution thus obtained. In a typical embodiment, 60 g stearine are added for each 100 g of water. In typical embodiments, the mixture of stearine and the basic solution is mixed with stirring for about 60 minutes with heating. In preferred embodiments, the mixing and stirring take place at a temperature of 75° C. or less. In most preferred embodiments, the mixing and stirring take place at a temperature of about 50° C. To this mixture, glycerol (typically 12 g for each 100 g $H_2O$ and borate (in preferred embodiments, as boric acid, typically 1.6 g boric acid for each 100 g $H_2O$) are added. In preferred embodiments, the two ingredients are added sequentially, and the mixture is held at 50° C. during the mixing. In more preferred embodiments, the two ingredients are stirred until they are fully dissolved. A surface-active agent (in preferred embodiments, sodium laureth sulfate) is then added. In preferred embodiments, 8 g sodium laureth sulfate is added for each 100 g $H_2O$. In typical embodiments, the resulting mixture is stirred for an additional period of about 40 minutes. Organic residues are then dispersed within this mixture. In a typical embodiment, 170 g organic residue is added for each 100 g and stirred for 120 minutes until a homogeneous soap composition is obtained. In preferred embodiments, small quantitites (typically on the order of 0.1-5%) of other ingredients, such as etheric (essential) oils, are added.

In additional embodiments of the invention, a somewhat different procedure is empolyed. First, organic residues are homogenized (in some embodiments, they are crushed prior to the homogenization). In some embodiments, the homogenized organic residues are mixed with preservatives. These preservatives can be, for example, etheric oils. Ethanol is then added to the homogenized residues.

In a second step of the procedure, glycerol and boric acid are mixed and heated together. The mixture is then added to the homogenized organic residue. In preferred embodiments, the two ingredients are added in an approximately 1:3 ratio.

In a separate step, a natural soap is produced by saponification of an oil (in preferred embodiments, a vegetable oil such as olive, coconut, palm, soy, etc.) by heating (in preferred embodiments, to approximately 50° C.) it in the presence of a base such as NaOH, KOH, $Na_2CO_3$, or $K_2CO_3$. In preferred embodiments, an excess of base is added.

The organic residue/glycerol mixture produced in the second step is then mixed with the soap produced in the third step to produce a homogeneous soap composition. The small size of the particles of homogenized organic residue produced in the first step ensures that no separation of the organic residues from the soap composition occurs. In embodiments in which an excess of base was added to the oil during the saponification process, this excess base will act to saponify at least a portion of the oil remaining in the organic residue.

In typical embodiments of the invention, the ingredients are mixed in proportions to produce a final soap composition comprising (weight percentages) 50-60% organic residue; 16-20% water; 12-15% natural oil; 3-4% base; 2-3% boric acid; 6-8% glycerol; 2% ethanol; and ~1% preservative.

Thus, the present invention provides a novel method of incorporating into a soap composition organic residues typically considered to be of no economic value.

Additional embodiments of the invention provide a novel method of producing soaps from said residues from processing of plant materials is herein disclosed. This method comprises the steps of (a) hydrolyzing at least one natural oil with base so that water soluble soap is obtained; (b) dispersing residues from processing of plant materials in said soap solution until a homogeneous soap composition phase is obtained.

According to one embodiment of the present invention, the hydrolysis is performed under basic conditions, e.g., at pH ranging from about 7.5 to 12.5.

According to another embodiment of the invention, the method additionally comprises admixing of glycerol.

According to another embodiment of the invention, the organic residues are selected from olive oil, olive products, olive tree products, olive oil production residuals, wine production residues, fruit or vegetable residues, canned food industries or any combination thereof.

According to another embodiment of the invention, the water-soluble soap is at least partially displaced by one or more synthetic surface-active agents.

According to another embodiment of the invention, the synthetic surface-active agents are selected from sulfonates, such as dodecyl benzene sulfonate and its derivatives; alkyl sulfate anionic surfactants; laurates, such as sodium laurate, sodium lauryl sulfates; ethanolamines, such as ethanolamine lauryl sulfate; polyethanolmides and mixture of ethanolamides of lauric acid or any mixture thereof.

Synthetic surface-active agents as defined above may be selected from anionic surfactants, such as alkyl benzene sulfonates, or sulfonates comprising potassium, sodium, ammonium, hydrogen or the like: sodium dodecyl benzene sulfonate and sodium tridecyl benzene sulfonate, commercially available surfactants selected from "Ardet" AB-40 (sodium dodecyl sulfonate), "Conco" AAS-50S (ammonium dodecyl benzene sulfonate), "Conco" ATR-98S (hydrogen tridecy) benzene sulfonate), "Memkal" NOBS (sodium nonyl benzene sulfonate), "Sole-Fonate" 102 (calcium dodecyl benzene sulfonate) etc. Other anionic surfactants comprising alkyl phosphates, and alkyl sulphosuccinates e.g., sodium dioctyl sulphosuccinate and sodium di(tertiary)nonyl sulphosuccinate. Examples of alkyl sulphosuccinates are the octyl and nonyl ester type. Other anionic surfactants are selected from secondary alkyl sulfate type, monoglyceride sulfate, isethionates, acyl sarcosines, and its derivatives. Amphoteric surfactants are potentially useful for the present invention and selected from coco amido alkyl betaine, acyl peptides and acyl amino acids.

Alkyl sulfate anionic surfactants, are preferably those derived from lauryl and myristyl alcohols, and its derivatives, such as alkyl polyethylene glycol sulfates (alkyl ether sulfates), e.g., lauryl polyethylene glycol sulfate.

Ethanolamines are selected according to one preferred embodiment of the present invention from the group consisting of monoethanolamine (MEA), diethanolamine (DEA) and triethanolamine (TEA). According to another embodiment of the invention, the synthetic surface-active agents are selected from anionic surfactants, especially those derived from lauryl and myristyl alcohols.

According to another embodiment of the invention, said method additionally comprises admixing of preservatives. It is acknowledged in this respect that the preservatives are preferably, yet not exclusively selected from biocides, bactericides or fungicides.

Hence, according to another embodiment of the invention, the method additionally comprises at least one step of admixing boric acid and/or borates; said borates are preferably selected from sodium, potassium, magnesium, calcium, barium manganese, ferrous borates or any combination thereof.

According to another embodiment of the invention, said preservatives comprise etheric oils. The etheric oils are preferably obtained form fruits or vegetables selected from linen blossoms (etheric oils with quercitin and farnesol) St. Johns wort oil (for example, olive oil extracts) calendula, arnica (for example oily extracts of blossoms with etheric oils, polar extracts with flavonoid lemon balm (for example flavone and etheric oils), sage (for example etheric oils with thymol) niseseed (etheric oils with trans-anethol), carnation oil (for example etheric oil with euaenol), camomile (camazulene, alpha-bisabolol, myrtols, (limonine, alpha-pinene, cineol), peppermint oil (for example, oil with menthol) caraway seed (for example, oil with carvone) larch (for example oil with alpha-pinene) Juniper, rosemarin, eucalyptus oil, lavender, fir needle oil, bergamo oil, citrus oil, lemon balm, marjoram, thyme, basil (stomatica or herbs) and fennel.

According to another embodiment of the inventioz said preservatives selected from methyl- and/or propyl-paraben.

More specifically, the aforesaid etheric oils are obtained from fruits and vegetables, selected from sage, rosemary, lemon, bergamot, tea tree, mint pine, sandalwood, patchouli, lemon grass peppermint, grapefruit, oridaniumz manuka, eucalyptus, geranium, clove, cinnamon, Melissa or any combination thereof.

According to another embodiment of the invention, the disclosed method additionally comprises admixing additives. The additives are preferably, yet not exclusively, selected from perfuming agents, stabilizers, thickeners, emulsifiers, vitamins, radical scavengers, conditioners, antioxidants, lipophilic or hydrophilic plant extracts or any combination thereof.

According to another embodiment of the invention, the method additionally comprises admixing fillers for viscosity regulation.

The fillers or viscosity regulators are preferably selected from calcium carbonate, talc, dolomite, perlite, magnesium carbonate or a mixture thereof.

According to another embodiment of the invention, water-soluble soap is obtained by hydrolyzing fats selected from vegetable oil, tallow, animal fats, cod liver oil, with sodium hydroxide or potassium hydroxide. Said method may further comprise at least one step of admixing the obtained soap without separating the biomass with etheric oil.

Vegetable oil may additionally comprise immunostimulants: echinacea purpuria (alcoholic extracts, fresh plant juice, pressed juice), elutheriococcus genticosus; alkaloids: rauwolfia, (for example, prajmaline evergreen, (for example vincamine); and phytopharmaceuticals, such as aloe, horse chestnuts (for example aescin), garlic (for example, garlic oil), pineapple (for example, bromelaein) ginseng (for example, ginsenoside), marythistle fruit (for example, extracts standardized on silbmarin), mouse thorn root (for example ruscogenine). Valeriana (for example valepotriate, and tincture valerainae nigh), Kava Kava (for example Cavalactone), hop blossom (hop bitters), extract of passiflorae, gentian (for example ethanol extract), anthraquinone containing drug extracts, (for example, aloin containing aloe vera juice), pollen extract, algin extract, liquorice extract, palm extract, galphimia (for example, prototincture), mistletoe, (for example, aqueous ethanol extract), phytosterols (for example, beta-sitosterine), verbascom (aqueous alcohol extract), droseria (liquor wine extract), sandthorn fruit, (for example the juice thereof), marshmallow root, primula root extract, fresh plant extracts of mellow, comfrey, ivy, Schachtelhalm, Yarrpwe, ribwart (for example pressed juice) nettles, celandine, parsley etc.

Alternatively, or additionally, the aforesaid method additionally comprises a step of reacting sodium or potassium hydroxide with oleic acid, tall oils, stearic or a combination thereof.

According to another embodiment of the present invention discloses a novel and cost effective soap, wherein said soap is obtained by dispersing synthetic and/or natural soap and liquid organic residues.

According to another embodiment of the invention, the soap additionally comprises fillers. The fillers or viscosity regulators are preferably selected from calcium carbonate, talc, dolomite, perlite, magnesium carbonate or a mixture thereof.

According to another embodiment of the invention, the soap additionally comprises preservatives.

According to another embodiment of the invention, the preservatives are selected from boric acid and/or borates. The borates are preferably selected from sodium, potassium, magnesium, calcium, barium manganese, ferrous borates or any combination thereof. The concentration of the borate-containing compositions is varied from about 0.1% to 5.0%; and preferably from about 0.15% to 0.5% (weight percent).

According to another embodiment of the invention, the preservatives are selected from biocides, bactericides or fungicides. The preservatives may comprise etheric oils. The etheric oils are preferably but not exclusively obtained form fruits or vegetables selected from linen blossoms (etheric oils with quercitin and farnesol) St. Johns wort oil (for example, olive oil extracts) calendula, arnica (for example oily extracts of blossoms with etheric oils, polar extracts with flavonoid lemon balm (for example flavone and etheric oils), sage (for example etheric oils with thymol) niseseed (etheric oils with trans-anethol), carnation oil (for example etheric oil with eugenol), camomile (camazulene, alpha-bisabolol, myrtols, (limonine, alpha-pinene, cineol), peppermint oil (for example, oil with menthol) caraway seed (for example, oil with carvone) larch (for example oil with alpha-pinene) Juniper, rosemary, eucalyptus oil, lavender, fir needle oil, bergamot oil, citrus oil, lemon balm, marjoram, thyme, basil (stomatica or herbs) and fennel.

According to another embodiment of the invention, the preservatives are selected from methyl- and/or propyl-paraben.

It within the scope of the present invention wherein the etheric oils are obtained from fruits and vegetables selected from sage, Rosemarie, lemon, bergamot, tea tree, mint, pine, sandalwood, patchouli, lemon grass, peppermint, grapefruit, oridanium, manuka, eucalyptus, geranium, clove, cinnamon, Melissa or a combination thereof. In preferred embodiments of the invention, the concentration of etheric oils ranges from about 0.1 to 5.0% (weight percent).

According to another embodiment of the invention, the soap as defined in any of the above additionally comprises additives, natural soaps, and/or glycerol.

According to another embodiment of the invention, the organic residues are obtained from oil cake mill. The oil obtained from the oil cake mill is preferably selected from olive oil, soy oil, linseed oil, sunflower oil or a mixture thereof. In more preferred embodiments, the soap additionally comprises water immiscible and/or water miscible process products or by-products obtained from oil cake milling. The products obtained from the oil cake milling are preferably, according to yet another embodiment of the present invention, ingredients of crushed seeds, especially crushed olive crushed pits or seeds. In other embodiments, organic residues are obtained from organic residues of juice production.

According to another embodiment of the invention, the method of producing olive soap as defined in any of the above comprises steps selected in a non-limiting manner from:

a. cleaning olives, e.g., rinsing them with water;
b. grinding or crushing the olives to paste;
c. mixing to increase olive oil yield;
d. separating or decanting the oil and water from pomace;
e. separating the oil from aqueous phase and optionally recycling the aqueous phase; and,
f. dispersing the pomace within the mixture produced in prior steps of the process from which the soap will be made until a homogeneous soap composition is obtained.
g.

In additional embodiments, the method further includes steps of h. hydrolyzing the oil such that a water soluble soap is obtained; and,
i. mixing the soap obtained in step (g) with that obtained in step (h).

According to another embodiment of the invention, the method further comprises a step of removing at least a portion of the pits from the olive flesh before the olives are ground to paste such that olive oil free of pits is obtained. The term "olive oil free of pits" refers to an olive oil free of pit fragments and components of the pits.

According to another embodiment of the invention, the method further comprises steps of removing at least a portion of the pits from the olive flesh before the olives are ground to paste and admixing said pits with the pomace.

According to another embodiment of the invention, the method further comprises a step of removing at least a portion of the pits from the olive flesh before the olives are around to paste and admixing the pits with the obtained soap.

According to another embodiment of the invention, the method further comprises a step of admixing said the aqueous phase (which is rich in polyphenols) with the soap until a homogeneous soap composition phase is obtained.

According to another embodiment of the invention, the method further comprises a step of admixing said etheric oils with the soap until a homogeneous soap composition phase is obtained.

According to another embodiment of the invention, the step or steps of separating of the oil and water from pomace is provided by either a tri-phase decanter or a two-phase decanter.

According to another embodiment of the invention, the grinding the olives to paste is performed by a disc-grinder.

According to another embodiment of the invention, the method additionally comprises applying an oxygen-free environment in at least a portion of said steps.

Some embodiments of the invention herein are now illustrated with reference to the following non-limiting examples.

Example 1

Glycerol (15 g) was admixed with stearine (150 g) at 75° C. until the stearine dissolved. Sodium laureth sulfate (ZOHARPON ETA-70) (40 g) was further admixed by means of a homogenizer. A water solution of borax ($Na_2B_4O_7$) (50 g, 0.3%) was admixed with sodium hydroxide (NaOH) (22 g). The sodium hydroxide—borax solution was mixed with 200 a of olive seed residue (6-10% oil) for 60 minutes at 75° C. in order to hydrolyze the oil portion of the olive seed residue. The reaction product was then mixed with the glycerol-stearine solution and the ETA-70 until the composition was fully homogenized. This product was further admixed with a mixture of pine oil (12 g) and clove oil (7.5 g). After cooling, approximately 500 g of good gelatinous soap was obtained.

Example 2

The same basic method as in the previous example was used. The ingredients for the reaction that produced the soap comprised 150 g water; 35 g NaOH; 0.3 g of 0.2% solution of borax in water; 20 g stearine; 20 g Sodium laureth sulfate (ZOHARPON ETA-70); 60 a glycerin; 250 g dense cake of crushed and compressed olive seed husks (6-8% oil); 1.25 g tea tree oil; 1.25 g lemon grass; and 110 g $MgCO_3$.

Example 3

A third soap was produced by the same method. The ingredients for the reaction that produced said soap comprised 150 g water; 35 g NaOH; 2 g lauramide; 0.3 g of 0.2% solution of borax in water; 20 g stearine; 18 g Sodium laureth sulfate (ZOHARPON ETA-70); 60 g glycerin; 290 g dense cake of crushed and compressed olive seed husks; 1.45 g tea tree oil; 1.45 g cinnamon oil; and 90 g perlite.

Example 4

A liquid soap was produced by a method according to the present invention. The ingredients for the reaction that produced said liquid soap comprised 150 g water; 15 g olive oil; 5 g coconut oil; 5 g lauramide; 5.45 g KOH; 2 g pine oil; 12 g glycerol; 5 g of 0.3% solution of borax in water; 3 g orange oil; 50 g soy oil; solid residues; and 40 g dolomite.

Example 5

Another soap was produced by a method according to the present invention. The ingredients for the reaction that produced said soap comprised 300 g water; 7.1 g NaOH; 38 g lauramide; 0.3 g of 0.2% solution of borax in water; 60 g glycerin; 38 g stearic acid; 18 g Sodium laureth sulfate (ZOHARPON ETA-70); 60 g glycine; 440 g dense cake of crushed and compressed olive seed husks; 8.8 g pine oil; 2.68 g clove oil; and 80 g talc.

Example 6

Another soap was produced by a method according to the present invention. The ingredients for the reaction that produced said soap comprised 150 g water; 3.5 g NaOH; 38 g lauramide; 3 g of 0.2% solution of borax in water; 20 g stearine; 20 g Sodium laureth sulfate (ZOHARPON ETA-70); 40 g glycerin; 250 g dense cake of crushed and compressed olive seed husks 1.25 g lemon grass; and 50 g perlite.

Example 7

Another soap was produced by a method according to the present invention. The ingredients for the reaction that produced said soap comprised 150 g water; 3.5 g NaOH; 2.5 g lauramide; 0.3 g of 0.2% solution of borax in water; 25 g stearine; 25 g Sodium laureth sulfate (ZOHARPON ETA-70); 250 g glycerin; 250 g dense cake of crushed and compressed olive seed husks; 1.25-2.5 g tea tree oil; 2.5 g lemon grass; and 30 g $CaCO_3$.

I claim:

1. A method of making an organic-residue-based soap, wherein said method comprises:

a. preparing a solution of a base in water;

b. reacting said solution with stearic acid;

c. adding glycerol;

d. adding a borate;

e. adding a surface-active agent;

f. dispersing an organic residue within the mixture, said organic residue selected from the group consisting of (a) olive seed residue remaining after the extraction of olive oil from said olives within said mixture and (b) crushed and compressed olive seed husks within said mixture; and, g. reacting said organic residue until a homogeneous soap composition is obtained.

2. The method according to claim 1, wherein said step of dispersing an organic residue within the mixture further comprises a step of dispersing within the mixture an organic residue selected from the group consisting of olive products, olive tree products, olive oil production residuals, wine production residues, fruit or vegetable residues, residue from the production of canned food, and any combination thereof.

3. The method according to claim 1, wherein said step of dispersing an organic residue within the mixture further comprises a step of dispersing within the mixture an organic residue selected from the group consisting of water immiscible process products obtained from oil cake milling; water miscible process products obtained from oil cake milling; byproducts of oil cake milling; and any combination thereof.

4. The method according to claim 1, wherein said step of dispersing an organic residue within the mixture further comprises a step of dispersing within the mixture an organic residue comprising crushed seeds obtained from oil cake milling.

5. The method according to claim 4, wherein said crushed seeds are crushed olive pits.

6. The method according to claim 1, wherein said step of dispersing an organic residue within the mixture further comprises a step of dispersing within the mixture an organic residue comprising a byproduct of juice production.

7. The method according to claim 1, wherein said base is selected from the group consisting of NaOH, KOH, $Na_2CO_3$, $K_2CO_3$, and mixtures thereof.

8. The method according to claim 1, wherein said borate is selected from the group consisting of boric acid; any borate of a metal chosen from the group consisting of sodium, potassium, magnesium, calcium, barium, manganese, and iron; and any combination thereof.

9. The method according to claim 1, wherein said step of adding borate further comprises a step of adding between 0.1% and 5.0% borate relative to the total weight of the ingredients.

10. The method according to claim 1, wherein said step of adding borate further comprises a step of adding between 0.15% and 0.5% borate relative to the total weight of the ingredients.

11. The method according to claim 1, wherein said surface-active agent is selected from the group consisting of sulfonates; alkyl sulfate anionic surfactants; laurates; ethanolamines; polyethanolmides; mixtures of ethanolamides of lauric acid; and any mixture thereof.

12. The method according to claim 1, further comprising a step of adding at least one etheric oil.

13. The method according to claim 12, wherein said etheric oil comprises at least one etheric oil obtained from fruits or vegetables selected from the group consisting of St. John's wort, calendula, arnica, niseseed, flax, peppermint, spearmint, tea tree, pine, fir, larch, juniper, eucalyptus, citrus, sandalwood, clove, cinnamon, patchouli, lavender, carnation, chamomile, bergamot, citrus, lemon grass, sage, rosemary, caraway, marjoram, thyme, basil and fennel.

14. The method according to claim 12, wherein said step of adding at least one etheric oil further comprises a step of adding between 0.1 and 5.0% etheric oil relative to the total weight of all of the ingredients.

15. The method according to claim 1, further comprising a step of adding at least one preservative.

16. The method according to claim 15, wherein said preservative is-selected from the group consisting of biocides, bactericides, and fungicides.

17. The method according to claim 15, wherein said preservative is selected from the group consisting of methylparaben, propylparaben, and combinations thereof.

18. The method according to claim 1, additionally comprising a step of admixing at least one additive.

19. The method according to claim 18, wherein said additive is selected from the group consisting of perfuming agents, stabilizers, thickeners, emulsifiers, vitamins, radical scavengers, conditioners, antioxidants, lipophilic plant extracts, hydrophilic plant extracts, and any combination thereof.

20. The method according to claim 1, additionally comprising a step of admixing at least one viscosity-regulating filler.

21. The method according to claim 20, wherein said viscosity-regulating filler is selected from the group consisting of calcium carbonate, talc, dolomite, perlite, magnesium carbonate, and any mixture thereof.

22. The method according to claim 1, wherein said steps of adding glycerol, adding borate, and adding a surface active agent are performed sequentially following said step of reacting said stearic acid with said solution of a base in water.

23. The method according to claim 22, wherein said step of adding said surface active ingredient is performed following complete dissolution of said glycerol and said borate.

24. The method according to claim 1, wherein at least one of said step of reacting stearic acid with said solution of a base in water; said step of adding glycerol; and said step of adding borate is performed at a temperature of not more than 80° C.

25. The method according to claim 1, wherein at least one of said step of reacting stearic acid with said solution of a base in water; said step of adding glycerol; and said step of adding borate is performed at a temperature of about 50° C.

26. A method of making an organic-residue-based soap, wherein said method comprises:

a. preparing a solution of a base in water;

b. reacting said solution with stearic acid;

c. adding glycerol;

d. adding a borate;

e. adding a surface-active agent;

f. dispersing crushed olive pits and compressed olive seed husks within the mixture; and, g. reacting said organic residue until a homogeneous soap composition is obtained.

* * * * *